US006572094B1

(12) United States Patent
Beisch

(10) Patent No.: US 6,572,094 B1
(45) Date of Patent: Jun. 3, 2003

(54) STACKING DEVICE FOR FLAT, UPRIGHT MAIL PIECES

(75) Inventor: Hanspeter Beisch, Radolfzell (DE)

(73) Assignee: Siemens Aktiengesellschaft, Munich (DE)

( * ) Notice: Subject to any disclaimer, the term of this patent is extended or adjusted under 35 U.S.C. 154(b) by 110 days.

(21) Appl. No.: 09/715,760

(22) Filed: Nov. 17, 2000

(30) Foreign Application Priority Data

Dec. 20, 1999 (DE) ..... 199 61 513

(51) Int. Cl.[7] ..... B65H 5/00
(52) U.S. Cl. ..... 271/2
(58) Field of Search ..... 271/2, 129, 127, 271/149, 150, 152, 214, 215

(56) References Cited

U.S. PATENT DOCUMENTS 3,118,664 A * 1/1964 Fux ..... 271/214
4,643,626 A * 2/1987 Noguchi et al. ..... 211/51
5,056,432 A * 10/1991 Sugimoto et al. ..... 101/227
5,221,080 A * 6/1993 Ricciardi ..... 271/2
5,393,196 A 2/1995 Bluemle ..... 414/790.2
5,833,076 A 11/1998 Harres et al. ..... 211/51

FOREIGN PATENT DOCUMENTS

DE 41 17 434 A 1 3/1992

* cited by examiner

*Primary Examiner*—Christopher P. Ellis
*Assistant Examiner*—Mark A. Deuble
(74) *Attorney, Agent, or Firm*—Philip G. Meyers

(57) ABSTRACT

The invention pertains to a stacking device for flat, upright mail pieces of different sizes, with a support (5) for holding the stack which can be displaced in the stacking direction in accordance with the thickness of the stack, and with a stacking point, to which the mail pieces (1) are transported in order to form the stack. The invention is characterized by the fact that the support (5) is arranged such that it can, during the course of its movement in the stacking direction, be displaced from a lower position, in which it reliably holds the largest portion of the front side or the rear side of the smallest mail pieces (1), into an upper position, in which the lower portion of the support (5) is situated underneath the upper edge of the smallest mail pieces (1) and the upper portion of the support (5) is situated above the center of gravity of the largest mail pieces (1).

8 Claims, 2 Drawing Sheets

STACKING DEVICE FOR FLAT, UPRIGHT MAIL PIECES

TECHNICAL FIELD

The invention pertains to a stacking device for a flat, upright mail pieces.

BACKGROUND OF THE INVENTION

In sorting stations for flat mail pieces, e.g., letters, postcards and the like, stacks of mail pieces are decollated in order to carry out the subsequent sorting process as well as combined into stacks, e.g., in stacking compartments that lie adjacent to one another. In this case, the flat mail pieces are transported while being clamped between cover bands and stacked in an upright position.

The stack being formed needs to be held opposite to the supply side of the mail pieces such that it does not overturn. Supports that can be displaced in the stacking direction are used for this purpose. Different variations are available for controlling the displacement process. For example, the thicknesses of the mail pieces to be stacked are measured and the support is correspondingly displaced away from the stacking point by means of a drive.

In an inexpensive variation, the mail pieces are obliquely transported to the stacking point in the direction of the support. Due to the force component in the stacking direction, the support is displaced away from the stacking point against the force of a spring that acts in the direction of the stacking point.

Once the stack has reached its nominal size, the support is laterally tilted such that the stack can be pushed out of the stacking compartment in an unobstructed fashion. In order to prevent the support being moved into the region of the adjacent stacking compartment, the support cannot exceed a certain size. After the stacking compartment is emptied, the support is pushed or pulled toward the stacking point by the force of a spring.

If the mail pieces to be stacked have different sizes, the stack begins to overturn once a certain stack thickness is reached because the larger mail pieces tilt over the relatively small support. An elevated arrangement of the support is not possible because the smaller, flexible mail pieces would otherwise slide through underneath the support.

Consequently, the invention is based on the objective of developing a stacking device for flat, upright mail pieces of different sizes with a support of limited size which holds the stack and can be displaced in the stacking direction, and with a stacking point, at which the mail pieces are stacked in an orderly pattern without being tilted.

SUMMARY OF THE INVENTION

At the beginning of the respective stacking process, the relatively small support is situated in a lower position, in which small and flexible mail pieces cannot slide through underneath the support and large mail pieces can still be held. In order to prevent tilting of the large mail pieces over the support as the thickness of the stack increases, the support is gradually moved into an elevated position, in which the upper portion of the support is situated above the center of gravity of the largest mail piece and the lower portion of the support is situated underneath the upper edge of the smallest mail piece. Due to the no longer flexible stack, the small mail pieces are no longer able to slide through underneath the support. As used herein, the term "large mail piece" refers to a mail piece that is significantly larger than the inner face of the blade of the support as best shown in FIG. 2, and is therefore likely to tip over the support during the stacking process.

Since large mail pieces, depending on the array, frequently begin to tilt only once a certain stack thickness is reached, the upward movement of the support advantageously takes place only once a selectable stack thickness is reached. The movement of the support from the lower position into the upper position can be advantageously realized in the form of a pivoting movement. In this case, it is advantageous to arrange the support in a pivoted fashion on the displacement path, namely in the same horizontal position, and to guide the support outside of the pivoting point by means of an ascending rail in such a way that the support is pivoted upward during the displacement in the stacking direction.

In another aspect, the invention provides a stacking device for mail pieces that includes a guide aligned in the direction of stacking of the mail pieces, a support having a blade for supporting a stack of flat, upright mail pieces by engaging an endmost mail piece, the support being moveable along the guide as mail pieces are stacked to retain the mail pieces in the stack, and a pivot mechanism including a bearing that is connected to the guide and pivotally mounted on the guide, which pivot mechanism causes the support to pivot upwardly at one end thereof adjacent the guide when the support reaches a predetermined position along the guide. The pivot mechanism causes the support to pivot upwardly at one end thereof adjacent the guide when the support reaches a predetermined position along the guide, thereby better supporting the stack of mail as described above.

In another advantageous embodiment, no pivoting movement takes place. In this case, the support remains in the same pivoting position, and the bearing point of the support is moved upward as the stack thickness increases. For example, instead of using an inclined rail as part of the pivot mechanism as described hereafter, the guide could be set at an incline so that the entire support assembly moves upwardly while maintain a horizontal position as the stack thickens.

The invention is described in greater detail below with reference to one embodiment that is illustrated in the figures.

DETAILED DESCRIPTION

Figure 1:
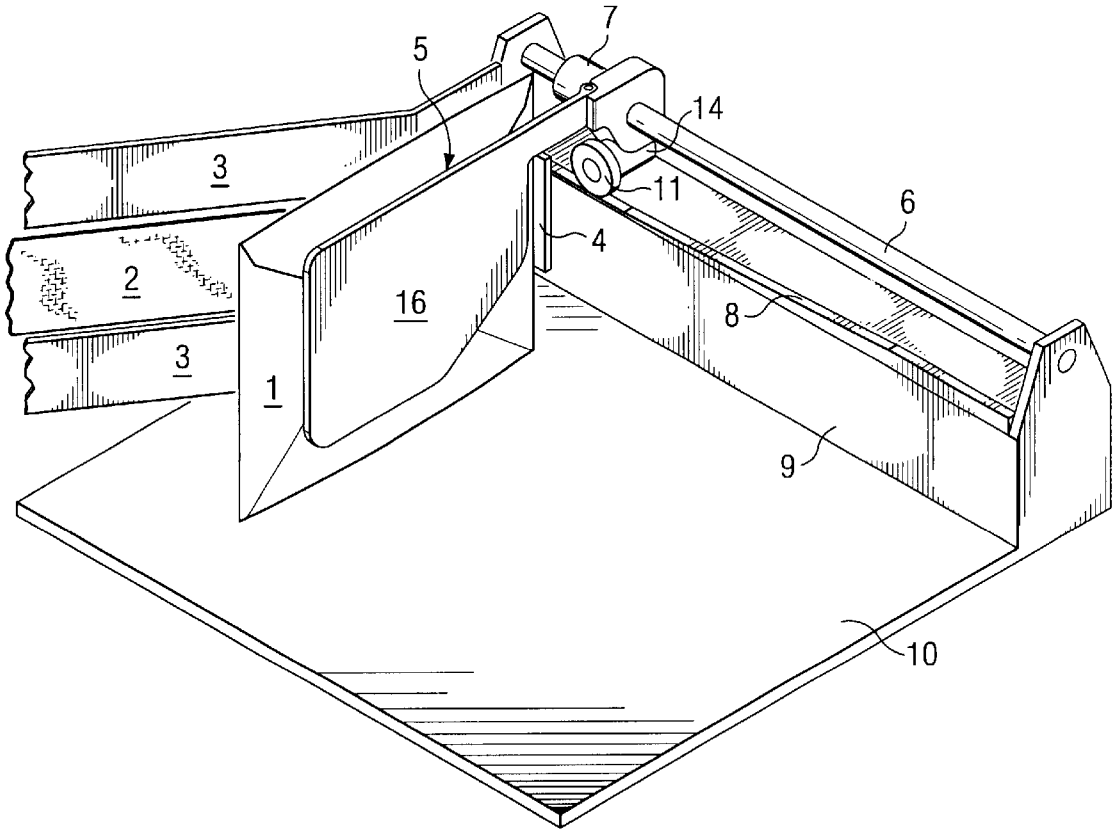
FIG. 1, is a perspective view of a stacking device in accordance with the invention for a stacking compartment with a first, small stacked mail piece.

According to FIG. 1, a mail piece 1, in this case, a small mail piece, is transported to the stacking point by the rear band 2 of the cover band mail piece feeder system. The front band of the cover band system ends before the stacking compartment, with the parts of the stacking compartment which obstruct the view of the stacking device not being illustrated. Guide plates 3 form a mail piece guide situated above and underneath the rear band 2 in order to guide the mail pieces 1. The rear band 2 and the guide plates 3 guide the mail pieces 1 obliquely against an impact plate 4, at which point they are decelerated, against the rear compartment wall 9 viewed in the moving direction and against a pivotal support 5 that prevents the mail pieces situated on the bottom 10 of the stacking compartment in an upright fashion from overturning. The support is mounted on a straight round rod or support guide 6 such that it can be displaced and pivoted by means of a bearing 7, with the round rod being horizontally aligned in the stacking direction. A not-shown tension spring slightly pulls the support 5 in the direction of the stacking point. The force component in the stacking direction which is generated by the mail pieces 1 that are obliquely transported onto the support 5 or onto the already existing stack with a relatively high speed presses the support away from the stacking point against the force of a spring. Due to this measure, the support 5 constantly adjoins the stack, but is displaced on the round rod 6 by the arriving mail pieces and pulled toward the stacking point again after the finished stack is removed. The support 5 naturally can also be moved away from the stacking point by means of a drive.

In order to prevent tilting of large mail pieces 1 over the support 5 as the thickness of the stack increases, the support needs to be moved into an elevated position. This is achieved by pivoting the support 5 upward with the aid of a running wheel or similar follower 11 that is rotatably mounted on the support and rolls on an ascending rail or track 8, and by a lifting arm 14 that is arranged between the pivoting point and the running wheel 11.

Figure 2:
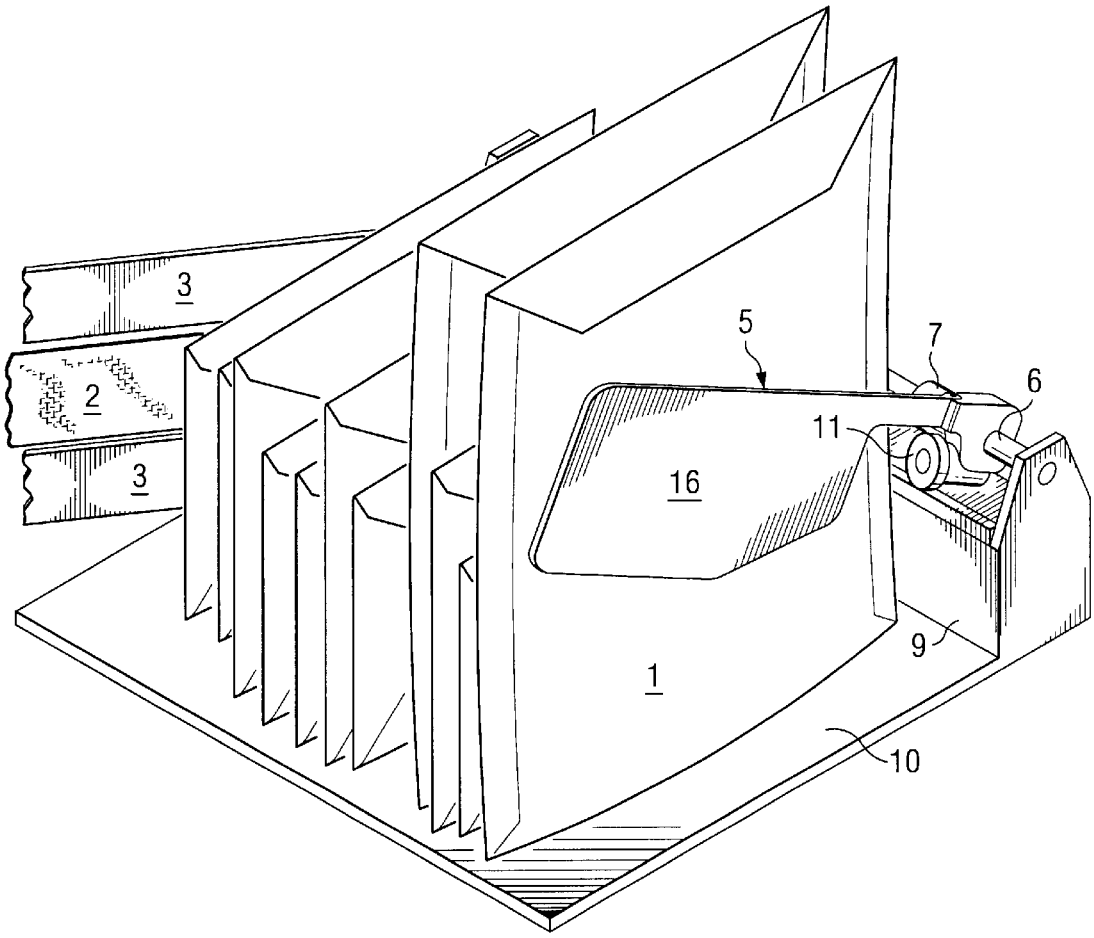
FIG. 2 is a perspective view of the stacking device of FIG. 1 with a stack of mail pieces that has approximately reached its maximum thickness and contains mail pieces of various sizes.

In the upper end position which is shown in FIG. 2, large mail pieces can no longer tilt over the support 5 because they are held above their center of gravity. Since the tilting of large mail pieces 1 only occurs once a certain stack thickness is reached, the rail 8 is only upwardly sloped starting at this position. In particular, rail 8 includes a first, innermost and lower horizontal section where guide 8 remains horizontal (untilted), a second upwardly-sloped section where guide 8 pivots on rod 6 so that the enlarged, generally rectangular blade 16 of guide 5 starts to pivot upwardly, and a third, outermost upper horizontal portion during which the blade 16 remains in the tilted position shown in FIG. 2. This is generally an acute angle less than about 45 degrees as shown.

It will be understood that the foregoing description is of preferred exemplary embodiments of the invention, and that the invention is not limited to the specific forms shown.

What is claimed is:

1. Stacking device for flat, upright mail pieces of different sizes, with a support for holding the stack which can be displaced in the stacking direction in accordance with the thickness of the stack, and with a stacking point, to which the mail pieces are transported in order to form the stack, characterized by the fact that the support is arranged such that it can, during the course of its movement in the stacking direction, be displaced from a lower position, into an upper position; and wherein the support is arranged in a pivoted fashion on the rod in the same horizontal position in order to carry out the pivoting movement, with the support being guided by a running wheel that rolls on an ascending track.

2. The stacking device according to claim 1, characterized by the fact that the support is arranged such that it is only moved upward once a selectable stack thickness is reached.

3. The stacking device according to claim 1, characterized by the fact that the support is moved from the lower position into the upper position by means of a pivoting movement.

4. A stacking device for mail pieces, comprising:

a guide aligned in the direction of stacking of the mail pieces;

a support having a blade for supporting a stack of flat, upright mail pieces by engaging an endmost mail piece, the support being moveable along the guide as mail pieces are stacked to retain the mail pieces in the stack;

a pivot mechanism including a bearing that is connected to the support and pivotally mounted on the guide, which pivot mechanism causes the support to pivot upwardly at one end thereof adjacent the guide when the support reaches a predetermined position along the guide;

a rail having a surface portion that is inclined in the direction of stacking of the mail pieces; and a follower that moves along the surface portion of the rail, wherein upward movement of the follower along the rail results in pivoting of the support.

5. The stacking device of claim 4, wherein the blade moves from a horizontal position to an upwardly tilted position as the support moves along the guide.

6. The stacking device of claim 4 further comprising a belt feeder that feeds mail pieces to an end of the stack remote from the support.

7. The stacking device of claim 4, wherein the guide comprises a horizontal circular rod, and the support extends horizontally at one of its ends in a direction perpendicular to the rod.

8. The stacking device of claim 7, further comprising:

a feeder system that loads mail pieces horizontally onto one end of the stack, and an impact plate that extends upwardly in the direction of stacking of the mail pieces, whereby a leading edge of a mail piece loaded by the feeder system contacts the impact plate.

* * * * *